United States Patent [19]

Lundström

[11] 4,282,617

[45] Aug. 11, 1981

[54] BOAT HULL, MATERIAL OR BLANK FOR A BOAT HULL, AND A METHOD OF PRODUCING A BOAT HULL

[76] Inventor: Claes Ö. S. Lundström, Järvstigen 9, S-17177, Solna, Sweden

[21] Appl. No.: 916,061

[22] Filed: Jun. 16, 1978

[51] Int. Cl.[3] ..... B63B 3/00; B63B 5/00

[52] U.S. Cl. ..... 9/6 R; 114/88; 144/327; 9/2 C; 9/6 P

[58] Field of Search ..... 144/320, 322, 324, 327; 9/2 R, 2 F, 2 S, 6 R, 6 M, 6 P, 6 W, 6.5; 114/271, 65 R, 82, 84, 79 R, 79 W, 56, 63, 77 R, 77 A

[56] References Cited

U.S. PATENT DOCUMENTS

| | | | |
|---|---|---|---|
| 1,346,161 | 7/1920 | Basquin | 144/327 |
| 2,232,313 | 2/1941 | Burch | 9/6.5 |
| 2,312,722 | 3/1943 | Lermont | 9/6 R |
| 2,634,436 | 4/1953 | Plaziak | 114/271 |
| 2,980,153 | 4/1961 | Burch | 144/322 |
| 3,675,692 | 7/1972 | Jeans | 144/327 |

*Primary Examiner*—Trygve M. Blix
*Assistant Examiner*—D. W. Keen
*Attorney, Agent, or Firm*—Frishauf, Holtz, Goodman and Woodward

[57] ABSTRACT

A boat hull is manufactured from a sheet or blank having cut-outs or slots formed therein, such that the blank when folded and when its cut-outs along its edges are mutually connected, a boat hull without a "boxy" shape will be obtained. The cut-outs or slots have enlargements at the tip ends (apices) thereof.

27 Claims, 10 Drawing Figures

BOAT HULL, MATERIAL OR BLANK FOR A BOAT HULL, AND A METHOD OF PRODUCING A BOAT HULL

BACKGROUND OF THE INVENTION

This invention relates to a boat hull which comprises a relatively stiff but flexible sheet, preferably in the preform of a flat piece of material or blank, which forms the body or shell and the bottom and which is provided with at least two first edges which are disposed substantially at a right angle to the boat hull center-line and which each extend from one outer edge of the sheet towards the center-line, said sheet being slotted in the direction of or parallel to the center-line or, alternatively, divided into two sheets in the direction of said center-line, said sheet or sheets after being bent or folded along the center-line and parallel thereto being joined together along the slot edges and, where applicable, also joined to an inserted square stern.

The invention also relates to a stiff, but flexible, and preferably flat material or blank in sheet form for utilization in the production of a boat hull as specified hereinbefore, such material or blank comprising two first edges, which are disposed substantially at right angles to a center-line of the blank and which each extend from one respective outer edge of the sheet and towards the said center-line, said sheet being provided with one or more slots extending substantially in the direction of or parallel to the center-line, or such sheet alternatively being divided into two sheets along said center-line.

The invention also relates to a method of producing a boat hull as specified hereinbefore, such method comprising providing a relatively stiff, but flexible, sheet of material or blank formed preferably as a flat piece of material or blank, with at least two first edges disposed substantially at right angles to a center-line of the blank, so that each of said first edges extends from one respective outer edge of the sheet and towards said center-line, and with one or more slots which extend substantially in the direction of or parallel to the center-line or, alternatively, said sheet is divided into two sheets along said center-line.

It is already known to form slots in a flat blank having a triangular cut-out, and to join the edges of the cut-out in order to form the flat sheet or blank into the final desired shape. Applications of this technique are found, for example, in the production of collapsible or folding boats.

Developments in the production of small boats of the fishing or leisure type during recent decades have been marked by a production technique based on reinforced plastic materials. New stricter enviromental regulations applicable to workplaces and the related inferior resistance due to new plastics used in the manufactured hull necessitate other production methods. One of the most interesting alternatives should be the production technique based on flat blanks or sheets as the starting material. The following alternative building materials may be applicable: steel sheets made from various alloys; aluminium from various alloys; plywood, consisting of various types of wood and constructed with different glueing techniques, such plywood blanks being produced in flat plate presses; and plastic blanks of homogeneous material or panels molded together and comprising an external finish section and a structural section. Common to all these materials is that because they are made in relatively small sizes, they generally have to be joined together to form a larger unit covering the entire sides of the hull. Where the term "body blank" is used hereinafter, this expression applies both to blanks which are joined together to form a larger blank before the actual body forming work, and factory-produced blanks of the required size.

A common factor in the known applications is that a point of varying conspicuousness occurs in the finished surface at the tip ends of the slots as a result of folding or bending, and this point readily occurs in the form of a projection, even after grinding down or working thereon in some other way. Such slots are usually made in the bow of the boat hull in order to form the stem shape. Typical slots of this kind are shown in U.S. Pat. No. 2,634,436. The boat shape shown therein, however, presupposes a certain double curvature of the flat starting material. Similar boat shapes are shown in U.S. Pat. No. 2,778,035, where the double curvature requirement is further stressed, and in U.S. Pat. No. 2,515,162.

Although only folds are shown instead of slots, U.S. Pat. No. 2,969,551 is relevant in this context. This patent shows a foldable boat of flat starting material. The known method illustrated, however, has no practical value, firstly because of the resulting boat shape and secondly because of difficulties in finding foldable material with adequate strength in the flat or singlebend surfaces.

The oldest method of producing boat hulls from flat starting material is based on structural steel techniques. Recent alloys have brought light metal constructions to the fore, but, in particular, the modern glueing techniques should promote hull constructions of plywood in every case in lighter-weight boats. A considerable quantity of boats of this type has been built and although developments have been relatively slow because of competition from reinforced plastic as a building material, there is already a highly developed tradition. The common factor in all constructions made from these materials, however, is the sharp bilges forming where the bottom and side walls are joined. An attempt has been made to reduce these bilges by the insertion of stringers, of round shape, to give part of the side walls a partly horizontal and a partly vertical curvature. Despite these steps, the boat hull is considered to be "boxy", a condition which, particularly in the case of motor boats, is accepted as hydrodynamically correct for hulls of the planing type. In this case the shapes are also camouflaged by web plates which are necessary for correct operation of the hull.

Particularly in the production of sailing boats, other parts of the fittings have been utilized as structural elements in cases where the hull is made from plywood. This process is described, inter alia, by Per Brohäll in his book "Bygg baten själv". This method saves both labor and material but it has had less applicability to metal hulls because the joining together of the metal plates by welding may result in damage to the fittings or may require extensive protective precautions.

The common feature of the prior art is that the hulls produced were given an exactly predeterined shape from the start by fitting the shell or body directly on a frame structure or on the internal fittings fixed bulkheads, beams, spacers at the stowage compartments or the like. Only in exceptional cases have fishing boat hulls been produced by forming the clinker shell against external sub-frames and then providing them with a frame shaped according to the resulting shell.

The object of the present invention is to use as a starting material a complete flat body blank which covers the entire port and starboard sides including the bottom, or alternatively a blank covering the entire body requirements, to allow a boat hull to be formed without sharp bilges or kinks into substantially any desired body shape.

SUMMARY OF THE INVENTION

According to the present invention, a blank for a boat hull has first edges which merge, at a distance inward from the outer edges of the sheet or sheets, into slots which extend substantially parallel to the center-line of the hull blank. After bending of the blank substantially parallel to the center-line, the slots are each joined together along the slot edges. The slots are provided, at their ends, with enlargements or holes, which are filled in after said bending. The present invention also contemplates a material in sheet form having the edges, slots and enlargements described above for use in the production of a boat hull.

The method according to the present invention, for the manufacture of a boat hull according to the foregoing by means of a material or blank in sheet form in accordance with the foregoing, comprises bending the sheet or blank along the center-line or parallel thereto, or jointing said two sheets together along the center-line, and then bending the sheet(s) along the extension of the slots substantially parallel to the center-line. Each of the first edges, after bending, is joined to one edge of an inserted square stern. Where the first edges are parts of slots, the edges of each such slot are respectively joined together, after bending, and the one or more slots extending substantially in or parallel to the direction of the center-line are joined together, after bending, in manner known per se along the edges of each slot. Then, the enlargements or holes are filled in.

BRIEF DESCRIPTION OF THE DRAWINGS

FIG. 10 shows a modification of the fifth example shown in FIG. 5.

DETAILED DESCRIPTION

Figure 1:
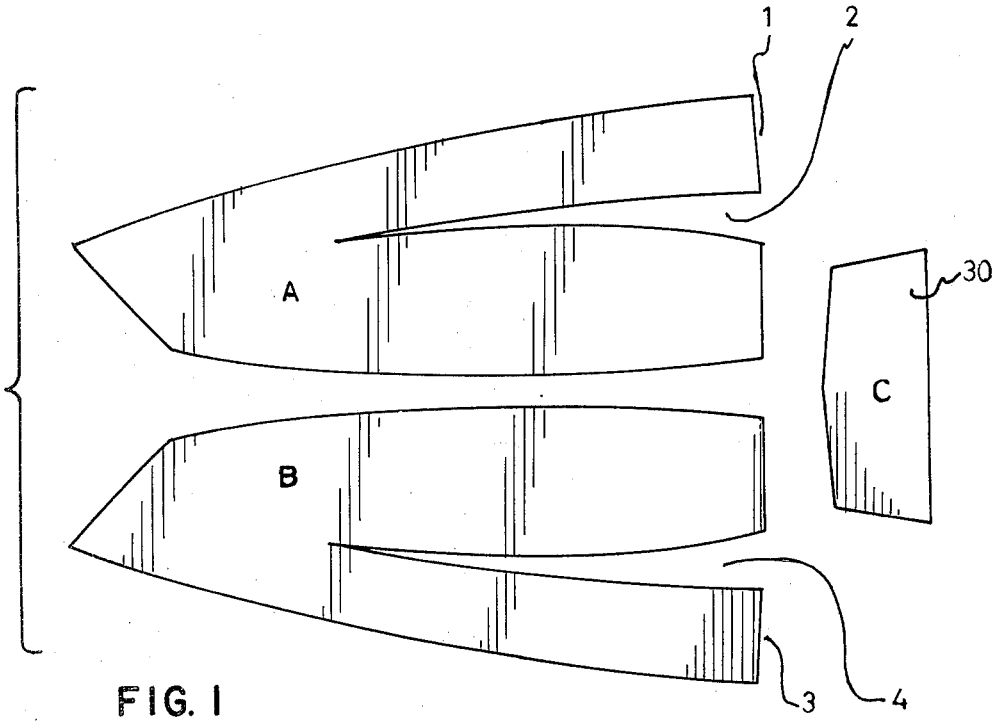
FIG. 1 shows a first example of how the slots are shaped in a boat hull blank.

The advantage of a complete body blank in one piece at the bottom is that this gives a straight keel board, which does not require glueing together. The blank is slotted to a predetermined pattern based on the hull shapes desired. A first example of such a slotting technique is shown in FIG. 1, and this technique gives the simplest form of hull with a rounded bow and sharp bilges from the midships part of the hull to the stern. In this case, the hull is shown as consisting of three sheet materials A-C, which are separate from one another in the initial position before folding and joining together, sheet C forming a square stern 30. Of course these three sheet materials A-C may be formed as a connected unit from a single sheet material, although they are shown separate from one another in FIG. 1. A first "slot" 1 is formed in the first sheet material A and extends from the outer edge of the first sheet A inwards and merges into a second slot 2. A first "slot" 3 is correspondingly also formed in the second sheet B and extends from the outer edge of the second sheet B inwards and merges into a second slot 4. Said second slots 2 and 4 in this case extend substantially at right angles to the first "slots" 1 and 3 and are substantially triangular, the apices of the triangles being formed with enlargements or holes 25 as shown diagrammatically in FIG. 8.

The sheet materials A and B are advantageously placed against a jig and bent so that the lines of symmetry or center-lines of the materials are in contact with one another, whereupon joining together is carried out. The materials A and B are bent or folded about the continuation of the first slots 2 and 4, whereupon the edges of the slots are joined together. Finally, the square stern 30 is fitted and joined to the bent and joined sheets A and B.

Figure 2:
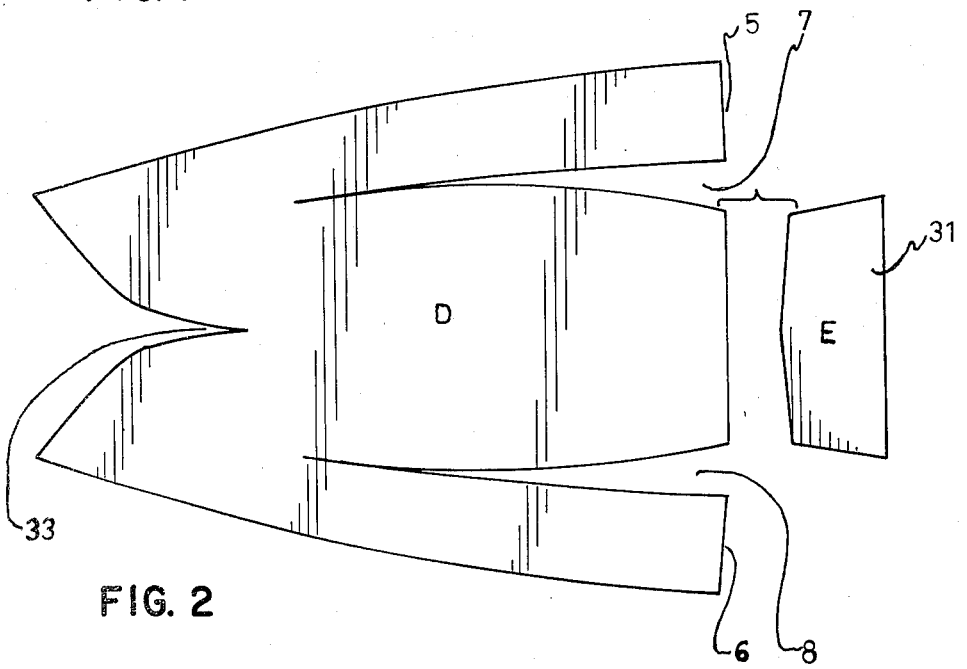
FIG. 2 shows a second example of how slots are shaped in a boat hull blank.

FIG. 2 shows the same technique as FIG. 1, but with a one-piece bottom, i.e., all the body material has a single blank D as the starting material. The first "slots" have been given the reference numerals 5 and 6 and the second slots reference numerals 7 and 8 while material E forming the square stern is denoted by reference numeral 31. The hull bow is formed by means of a third slot 33, which like the second slots 7 and 8, is provided with an enlargement 25 at its tip as shown in detail in FIG. 8.

Figure 3:
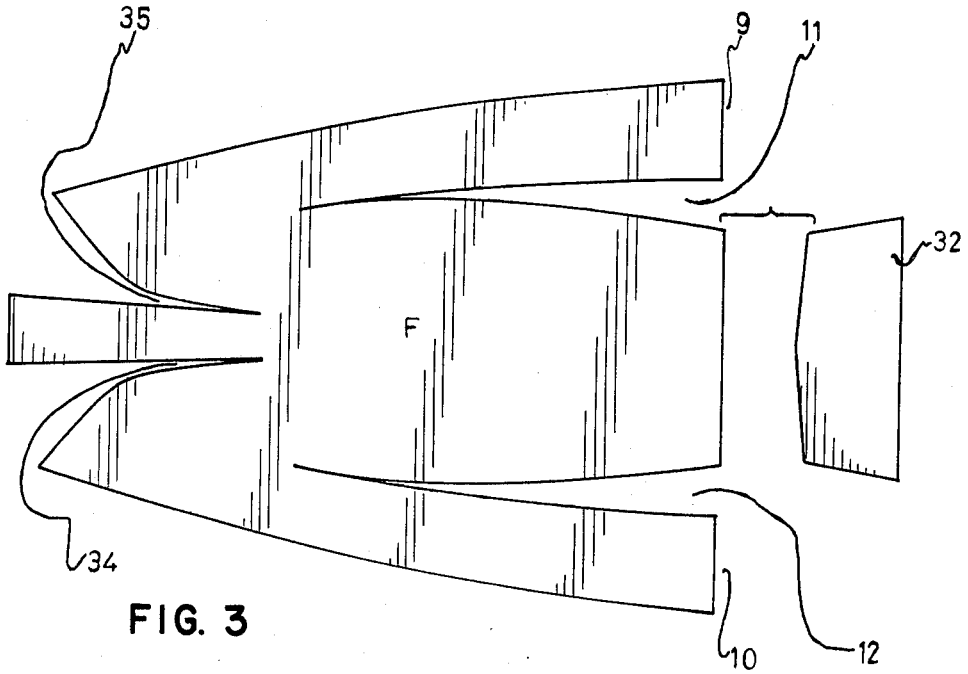
FIG. 3 shows a third example of how slots are shaped in a boat hull blank.

FIG. 3 illustrates substantially the same boat hull shape as FIG. 2 but with the bow formed on the stem post. That part of the sheet material F which after bending or folding forms the bow of the hull is in this case provided with two slots 34 and 35 which, like the second slots 11 and 12, are provided with enlargements 25 at their tips as shown in detail in FIG. 8.

Figure 4:
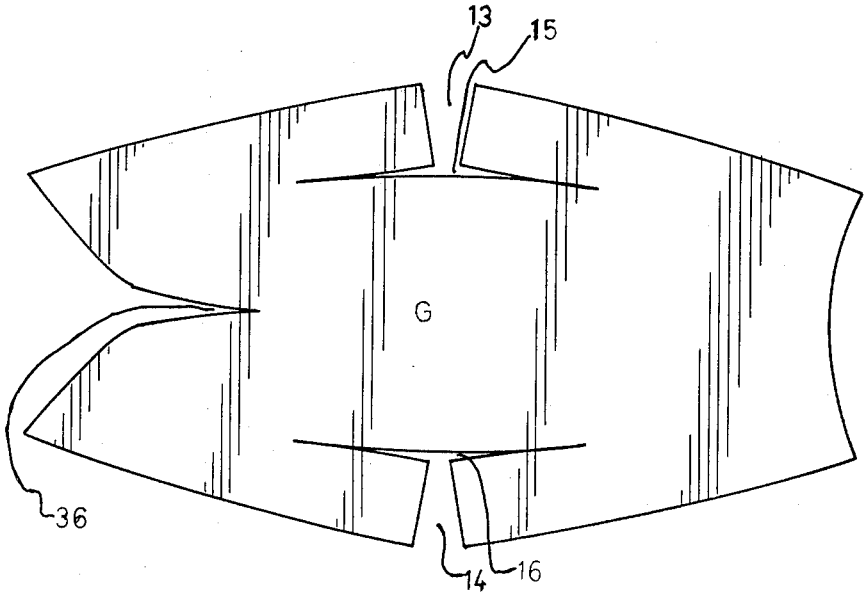
FIG. 4 shows a fourth example of how slots are shaped in a boat hull blank.
Figure 8:
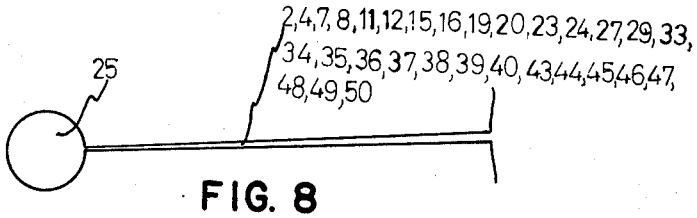
FIG. 8 shows an example of how a slot is finished.

FIG. 4 shows the slotting technique if a round bow is desired when using a one-piece blank G. In this case the square stern is not shown on the drawing. The first slots 13 and 14 in this case are constructed as parallel trapezia and the second slots 15 and 16 extend on both sides of the first slots 13 and 14. The slot 36 and the second slots 15 and 16 are provided at their apices with enlargements or holes 25 (FIG. 8). After bending or folding about the continuation or extension of the slot 36 and about the continuations or extensions of the second slots 15 and 16, the slot edges are joined together and in the final operation all the enlargements 25 are filled in.

Figure 5:
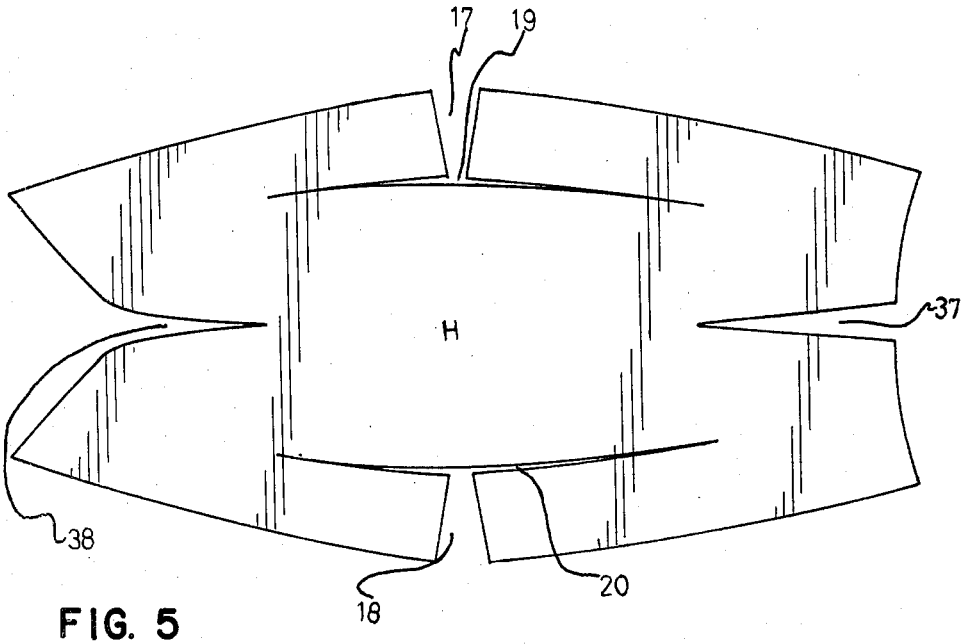
FIG. 5 shows a fifth example of how slots are shaped in a boat hull blank.

FIG. 5 shows the same technique as FIG. 4 but with a slot 37 in the stern, intended to give the material for a downbuilt fin and a better stern form with better traction. The square stern is not show here; otherwise FIGS. 4 and 5 correspond.

Figure 6:
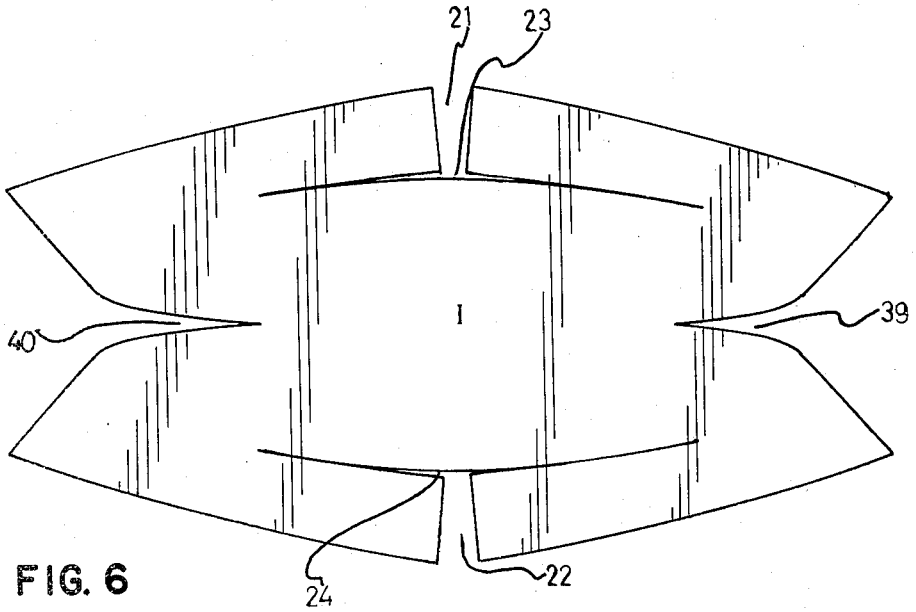
FIG. 6 shows a sixth example of how slots are shaped in a boat hull blank.

FIG. 6 shows the technique applied, for example, to a canoe, i.e. a body pointed both at the bow and at the stern. This sheet I is therefore formed with a slot 40 in the part which is to form the bow and a slot 39 in the part which is to form the stern.

Figure 9:
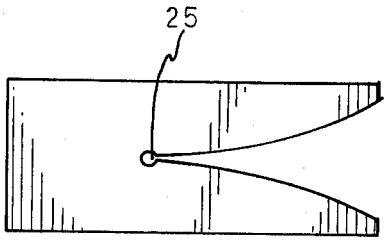
FIG. 9 shows part of an oar blade.
Figure 9:
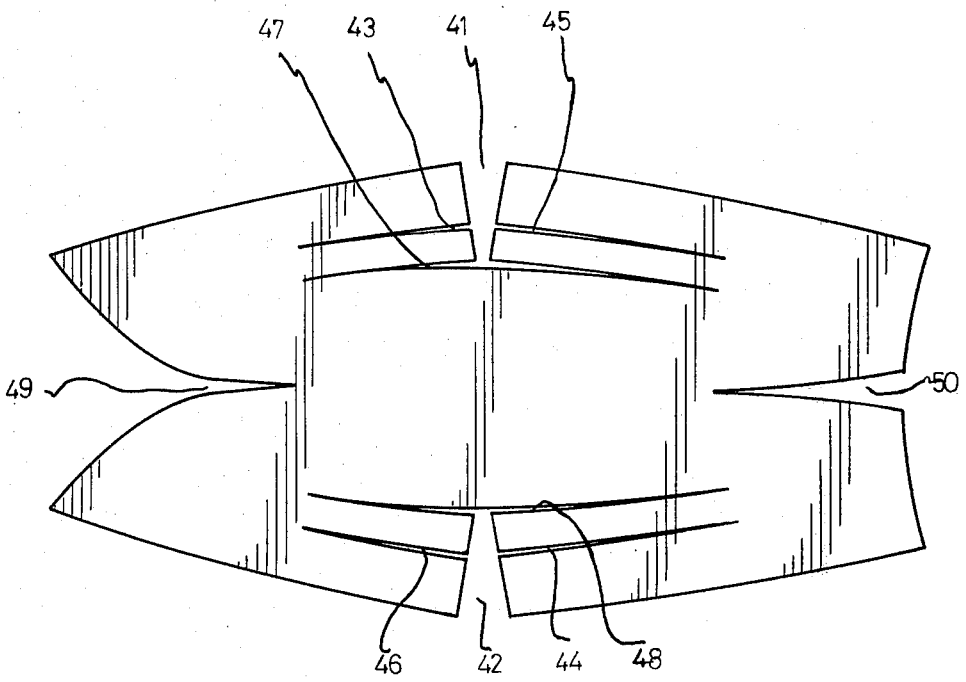

FIG. 9 shows an interesting application for the production of dished oar blades.

FIG. 10 shows an embodiment in which a plurality of parallel second slots 43 and 45, 47, and 46 and 48 are provided to give the body a still rounder shape compared with that obtained according to FIG. 5.

The slotting technique shown here is thus characterized by the fact that the points or tips of the slots terminate in an enlargement or hole 25 as shown in FIG. 8. The reason for this is that it avoids the projecting point (stress concentration) described above at this point when the body blank is folded. These enlargements or holes 25 are then filled in after the actual body forming work by means of a suitable filler material.

This invention is also based on the fact that a body having a "free" shape is formed by accurate construction and joining together of the slot edges. The natural flexure of the material gives soft shapes beneath the waterline and an aesthetically attractive curvature of the freeboard to the eye.

Another characteristic feature of the invention is that the freeboard blanks are usually given a round shape in the stern with the round shape extending vertically, the center part of the freeboard blank merges into the circular shape which extends horizontally and then merges, at the stern, into the vertical circle shape. A boat hull constructed in this way is interpreted by the eye as having a double-curvature and a soft shape without the impression of the above-mentioned "boxy" appearance.

Despite the fact that the folding together of the body blanks gives a "free" boat hull shape, the folding should take place over a jig or the like to give precision in fitting the edges of the slots together. In the case of small boats, particularly, this precision joining operation may alternatively be carried out by pulling together by means of metal wire or reinforced tape. However, this method is more difficult in the case of relatively hard materials which are more resistant to bending. Depending upon the joining technique used, a completed internal fitting may be used instead of the hull jig. The jig is required to be very stiff, since no change of shape may take place therein during folding together. The internal fittings are advantageously constructed by first building up a reinforcement box with longitudinal sides consisting of the vertical parts under thwarts and berths as the longitudinal sides, walls against stowage compartments and/or the square stern as the short sides, providing this box with abutment strips for floorboards, the thwart bottoms etc., and slots for bulkheads and bottom beams. The box is then built on with the bulkheads inserted in the slots, the beams, reinforcements between thwarts and berths, drawer, cupboard and galley fittings and other details to give a complete stiff internal fittings element. The body blank can then be disposed around this and joined together at the edges of its slots. The internal fittings can be secured to the body blank by glueing or by means of screws during actual work on the body or subsequently by plasticization or securing to glued strips or corresponding fixing methods. The advantage of this method is that the internal fittings can be prepared in substantially finished condition before the actual work on the body, thus obviating time-consuming climbing into and out of the hull during work on the internal fittings.

Figure 7:
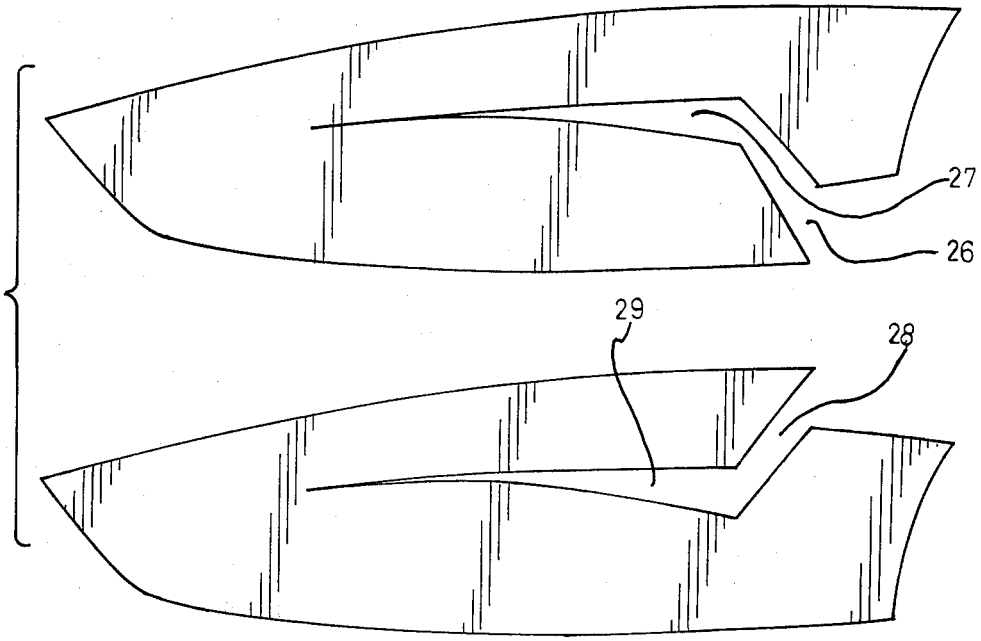
FIG. 7 shows a seventh example of how slots are shaped in a boat hull blank.

One other variant of the invention will be described. Instead of using a pre-fabricated blank of the same thickness as required in the hull, work on the body can be carried out using two or more thin blanks disposed one on the other. In that case the slots can be so devised that the construction of the blanks differs in such manner that the slot joints in the finished body will overlap one another. Examples of such slotting are shown in FIG. 7. The advantage of this method is that firstly the material used is more readily flexible while secondly there is a freer choice of shaping. This method also allows a reinforcing element, for example of fibre reinforced plastic or balsa wood, to be introduced as a core between the blanks.

What is claimed is:

1. In a boat hull which comprises at least one relatively stiff but flexible sheet which is bent to form the body or shell and the bottom of the hull and which also forms the broadest part of the hull after being bent and formed, the improvement wherein:

said at least one sheet has at least one first slot extending from one outer edge of the sheet towards the center-line of the boat hull, said at least one first slot having opposing first edges and being in the part of said at least one sheet forming the broadest part of the hull;

said at least one sheet has elongated second slots generally extending in the direction of or parallel to said center-line, the opposing edges of said second slots being joined together along the lengths thereof to form respective ends of said second slots;

said first edges of said at least one first slot merge, at a distance from said outer edges of said at least one sheet, into at least one of said elongated second slots; and said elongated second slots are provided, at their ends, with enlargements or holes (25) to remove stress concentrations when the sheet is bent, which enlargements or holes are filled in after forming of said hull.

2. Boat hull as claimed in claim 1 wherein said hull, up to a certain level, is bent essentially along a first line which is parallel to said center-line in a center-plane, and said hull, above said certain level, is bent essentially along a second line which is off-set roughly 90° in relation to said center-plane.

3. Boat hull as claimed in claim 1 wherein said at least two first edges extend substantially at a right angle to said boat hull center-line.

4. Boat hull as claimed in claim 1 wherein said at least one first slot extends substantially at a right angle to said boat hull center-line.

5. Boat hull as claimed in either of claims 1 or 4, wherein said elongated second slots which extend generally in said direction of or parallel to said center-line are generally triangular slots, the tip ends or apices of said elongated second slots being provided with said enlargements or holes.

6. Boat hull as claimed in claim 1, comprising at least two relatively stiff but flexible sheets which are bent to form the body or shell and the bottom of the hull, said sheets being joined substantially along said center-line of said boat hull, each of said sheets having at least one of said first slots and at least one of said elongated second slots.

7. Boat hull as claimed in any one of claims 1, 4 or 6, further comprising a generally rectangular stern sheet joined together with said at least one sheet which is bent to form the body or shell and the bottom of said hull.

8. Boat hull as claimed in claim 1, wherein said elongated second slots which extend generally in the direction of or parallel to said center line extend on both respective sides of a first slot.

9. Boat hull as claimed in claim 1, wherein said first edges extend at an angle to said center-line of said boat hull.

10. Boat hull as claimed in claim 1, wherein said at least one first slot extends at an angle to said center-line of said boat hull.

11. Boat hull as claimed in claim 1, comprising at least two superposed relatively stiff but flexible sheets which are bent to form said body or shell and the bottom of the hull, each of said superposed sheets having said first and second slots, at least one of each of said first and second slots being located in one of said superposed sheets in a different position relative to the other of said superposed sheets.

12. Boat hull as claimed in claim 1 wherein said elongated second slots are generally triangular and said first slots substantially form parallel trapezia having the longer side of the two mutually parallel outer edges of said sheet.

13. A relatively stiff, but flexible blank in the form of at least one sheet for use in producing a boat hull, said blank being bendable to form the body or shell and the bottom of the boat hull, said blank forming the broadest part of the hull after being bent and formed and said blank having a center-line corresponding to the center-line of the boat hull, the improvement wherein:

said blank has at least one first slot extending from one outer edge of the blank towards said center-line of the blank, said at least one first slot having opposing first edges and being in the part of said at least one sheet forming the broadest part of the hull;

said blank has at least one elongated second slot generally extending in the direction of or parallel to said center-line, the opposing edges of said at least one second slot being joined together along the lengths thereof to form respective ends of said at least one second slot;

said first edges of said at least one first slot merge, at a distance from said outer edges of said blank, into said at least one elongated second slot; and said at least one elongated second slot is provided, at the respective ends thereof, with enlargements or holes (25) to remove stress concentrations when the sheet is bent, which enlargements or holes are filled in after forming of said hull.

14. Blank as claimed in claim 13 comprising at least two of said elongated second slots, each merging with at least a respective first slot.

15. Blank as claimed in claim 14 wherein said elongated second slots are generally triangular, and substantially form together with said at least one first slots a parallel trapezia having the longer side of the two mutually parallel outer edges of said blank.

16. Blank as claimed in claim 14 wherein said at least one first slot extends substantially at a right angle to said center-line.

17. Blank as claimed in claim 14 wherein said elongated second slots are generally triangular slots, the tip ends or apices of said elongated second slots being provided with said enlargements or holes.

18. Blank as claimed in claim 14 comprising at least two relatively stiff but flexible sheets which are bendable to form the body or shell and the bottom of the boat hull, said sheets being joined substantially along the center-line of said boat hull, said center-line of said boat hull corresponding to the center-line of the resulting blank formed of said joined sheets, each of said sheets having at least one of said first slots and at least one of said second slots.

19. Blank as claimed in either of claims 13 or 15 wherein said first slots extend from the portions of said respective elongated second slots which are most remote from the center-line of said blank on either side of said blank, said elongated second slots being substantially triangular and having their wider sides connected with said respective first slots.

20. Blank as claimed in either of claims 13 or 15 wherein said elongated second slots extend from the part of said first slots which are located closest to said center-line of said blank, and wherein said elongated second slots are substantially triangular with their wider sides connected with said first slots.

21. Blank as claimed in any one of claims 13, 14 or 15 wherein said at least one first slot is located at the widest portion of said blank.

22. A method of producing a boat hull comprising:

providing at least one relatively stiff but flexible sheet of material having at least one first slot extending from one outer edge of the sheet towards the center-line of the resulting boat hull, said at least one first slot having opposing first edges and being in the part of said at least one sheet forming the broadest part of the hull;

providing said sheets with at least two elongated second slots which extend substantially in the direction of or parallel to said center-line of the resulting boat hull, said second slots being formed at a distance from said outer edges of said at least one sheet, each of said second slots having opposing edges which are joined together along the lengths thereof to form respective ends of said second slots, said first and second slots being provided such that said first edges of said at least one first slot merge, at a distance from said outer edges of said at least one sheet, into at least one of said second slots;

providing enlargements or holes at the ends of said elongated second slots to remove stress concentrations when said at least one sheet is bent;

bending said sheet along said center-line or parallel thereto and along the extensions of said first and second slots and joining the respective opposing edges of all of said respective slots; and filling in said enlargements or holes after the joining of said opposing edges of all of said slots.

23. Method as claimed in claim 22, further comprising joining a substantially rectangular stern sheet at least to said first edges.

24. Method as claimed in claim 22, wherein said sheet comprises at least two of said relatively stiff but flexible sheets, each of which has at least one of said first slots and at least one of said elongated second slots formed therein; and joining said at least two sheets along a line substantially parallel to said center-line.

25. Method as claimed in claim 24, wherein said at least two sheets are joined along said center-line of the resulting boat hull.

26. Method as claimed in claim 22, comprising superposing at least two stiff but flexible sheets of material, each of which has at least one first slot and at least one of said elongated second slots formed therein with enlargements or openings at the ends of said second slots.

27. Method as claimed in claim 26, wherein said superposed sheets have said first and second slots formed therein at different positions relative to each other.

* * * * *